US012207725B1

(12) United States Patent
Bickford

(10) Patent No.: US 12,207,725 B1
(45) Date of Patent: Jan. 28, 2025

(54) COMBINATION COSMETIC DROPPER AND APPLICATOR

(71) Applicant: L'Oreal, Paris (FR)

(72) Inventor: William Bickford, Scotch Plains, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 18/477,818

(22) Filed: Sep. 29, 2023

(51) Int. Cl.
*A45D 34/04* (2006.01)
*A45D 40/26* (2006.01)

(52) U.S. Cl.
CPC .... *A45D 34/046* (2013.01); *A45D 2200/1018* (2013.01); *A45D 2200/1036* (2013.01)

(58) Field of Classification Search
CPC ..... A45D 34/046; A45D 2200/1018; A45D 2200/1036; A45D 40/267; A45D 34/045; A45D 40/265; A45D 34/042; A45D 40/262; A45D 34/041; A45D 40/261
USPC ..... 401/13, 126–128, 130, 188 R, 263–266, 401/176, 179, 180; 222/492, 493, 494
See application file for complete search history.

(56) References Cited

U.S. PATENT DOCUMENTS 6,070,763 A * 6/2000 Gueret ..... B05B 11/1001 222/105
7,481,336 B2 * 1/2009 Arghyris ..... B05B 11/1074 222/491
2020/0237086 A1 7/2020 Crapet et al.
2020/0323327 A1 10/2020 Bose et al.
2022/0369791 A1 11/2022 Crapet

FOREIGN PATENT DOCUMENTS

KR 101770581 B1 8/2017
KR 102096492 B1 4/2020
WO 2021123335 A1 6/2021
WO 2021250230 A2 12/2021

* cited by examiner

*Primary Examiner* — David J Walczak
(74) *Attorney, Agent, or Firm* — Christensen O'Connor Johnson Kindness PLLC

(57) ABSTRACT

Applicators, container assemblies, kits, and methods for delivery of controlled, defined doses of cosmetic compositions to an individual's skin, hair, or other body part. An applicator includes a head that is slidably affixed to a shaft. The shaft includes a piston that is slidably positioned within the head. The head also includes a bias member that biases the head toward a distal position relative to the piston. As the bias member is overcome, the head slides down the shaft and the piston enters the head toward a deeper position within the head to displace and discharge the cosmetic from the interior of the head through an aperture of the head and onto the portion of the body of the individual. The applicator can be used for delivery of defined dosages of a variety of cosmetic compositions, including compositions with a relatively higher viscosity.

15 Claims, 16 Drawing Sheets

COMBINATION COSMETIC DROPPER AND APPLICATOR

SUMMARY

In an aspect, the disclosure provides an applicator for application of a defined dosage of a cosmetic composition, the applicator comprising: a head comprising an aperture that fluidly connects an exterior of the head to an interior of the head, wherein the head is slidably affixed to a shaft comprising a piston that is slidably positioned within the head; and a bias member that biases the head toward a distal position relative to the piston, wherein the distal position corresponds to a volume of the interior of the head for storage of the defined dosage of the cosmetic composition, wherein a force applied to the head toward the piston overcomes the bias member and slides the head along a length of the shaft and toward a proximal position relative to the piston for discharge of the defined dosage of the cosmetic composition from the volume of the interior through the aperture by the piston.

In embodiments, the aperture is disposed through a distal portion of the head and wherein the force is applied with contact of a skin surface to the distal portion of the head, such that with discharge of the defined dosage of the cosmetic composition from the aperture, the cosmetic composition contacts the skin surface.

In embodiments, the distal portion of the head is angled relative to an axis of the shaft of the applicator.

In embodiments, the bias member is unitary with the head.

In embodiments, the bias member is a stem that extends from a rim of the aperture into the volume of the interior of the head and contacts the piston of the shaft.

In embodiments, the bias member is a spring disposed between an interior ridge of the head and the piston.

In embodiments, a size of the spring corresponds with the defined dosage of the cosmetic composition.

In embodiments, the interior ridge of the head is positioned adjacent to the aperture of the head.

In embodiments, the shaft comprises a handle attachment at a distal portion thereof for attachment of the applicator to a handle.

In embodiments, the applicator further comprises the handle attached to the handle attachment of the shaft.

In embodiments, the volume of the interior of the head corresponds with the defined dosage based on a size of the piston and a distance traveled by the piston as the head transitions from the distal position to the proximal position relative to the piston.

In embodiments, the size of the piston is greater than a size of a portion of the shaft that enters the head as the head transitions from the distal position to the proximal position relative to the piston.

In an aspect, the disclosure provides a container assembly for storing and delivering a defined dosage of a cosmetic composition, the container assembly comprising an applicator and a bottle, and optionally, a wiper configured for attachment to an opening of the bottle and comprising an aperture for passage of the applicator therethrough for removal of excess cosmetic composition from the applicator during removal of the applicator from the bottle.

In embodiments, a diameter of the applicator and a diameter of the wiper are consistent with each other for a snug fit of the wiper to the applicator during removal of the applicator from the bottle.

In an aspect, the disclosure provides a kit comprising a container assembly and further comprising an instructional material, a product material, or an accessory.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

Figure 1A:
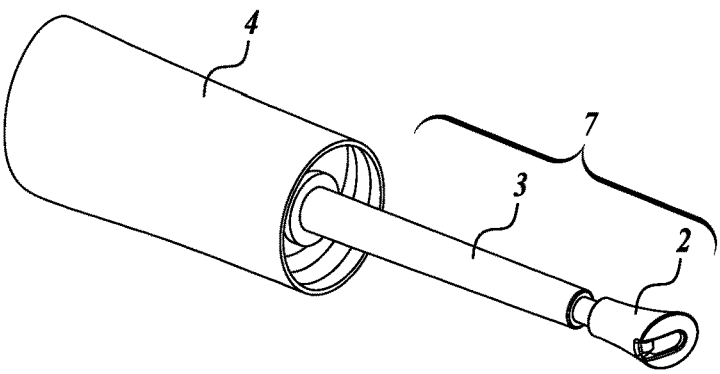
FIG. 1A shows a perspective view of an example applicator with handle attached, according to aspects of the disclosure.

The foregoing aspects and many of the attendant advantages of this invention will become more readily appreciated as the same become better understood by reference to the following detailed description, when taken in conjunction with the accompanying drawings.

DETAILED DESCRIPTION

Application of cosmetic compositions, such as lip gloss, lip color, creams, gels, ointments, foundations, concealers, sunscreen, acne treatments, and others, usually involves an individual controlling the dosage of the composition being applied to the body. This is often difficult, in particular when the composition is thick or viscous. In these and other situations, excess composition can be inadvertently applied to the body, resulting in undesired product application or prolonged efforts to apply a desired amount of the composition to the body. In addition to this being a frustrating experience for a consumer, it is also wasteful as excess composition is generally discarded and not used. Accordingly, there is a need for applicators for applying cosmetic compositions that facilitate greater control over and definition of dosages of compositions being applied. The present disclosure addresses this and other long-felt and unmet needs in the art.

In an aspect, the disclosure provides an applicator for application of a defined dosage of a cosmetic composition and avoidance of unnecessary or excess amounts of the composition, reducing waste and improving the quality and reproducibility of the product application process. Example applicators are shown at FIGS. 2A-2R and FIGS. 3A-3L. In various embodiments, an applicator 7 comprises a head 2 that comprises an aperture 9. Aperture 9 fluidly connects the exterior of the head to an interior of the head. Head 2 is slidably affixed to a shaft 3 that includes a piston 18 that is slidably positioned within the head. A bias member 10 biases the head 2 toward a distal position relative to the piston 18 (e.g., FIGS. 2A, 2C, 2E, 2G, 2I, 2K, 2M, 2O, 2Q, 3A, 3C, 3E, 3G, 3I, and 3K). As such, the head 2 is positionable within a bottle that comprises the cosmetic composition therein (see, e.g., bottle 6 of FIG. 1B), such that a force applied to the shaft 3 in a direction of a lower portion of the bottle contacts the head 2 to the lower portion of the bottle, overcomes the bias member 10, and slidably positions the head 2 toward a proximal position relative to the piston (e.g., FIGS. 2P, 3J), and such that removal of the force from the shaft 3 removes the head 2 from contact with the lower portion of the bottle, releases the bias member 10, and slidably positions the head 2 toward the distal position relative to the piston (e.g., FIGS. 2O, 3I), and concomitantly draws the defined dosage of the cosmetic composition from the exterior of the head 2 into the volume of the interior through the aperture by the piston. The distal position corresponds to a volume of the interior of the head configured to store the defined dosage of the cosmetic composition until it is applied to a portion of a body of an individual. As a force is applied to the head 2 in the direction of the piston 18, this overcomes the bias member 10 and slides the head 2 along a length of the shaft 3 and toward a proximal position relative to the piston 18 (e.g., FIGS. 2B, 2D, 2F, 2H, 2J, 2L, 2N, 2P, 2R, 3B, 3D, 3F, 3H, 3J, and 3L) for discharge of the defined dosage of the cosmetic composition from the volume of the interior of the head 2 through the aperture 9 by the piston 18. Since the volume within the head 2 is defined, the amount of the composition holdable by the head 2 is also defined and consistent between applications.

In embodiments, the aperture 9 is disposed through a distal portion of the head 2. The force for slidably moving the head 2 along the shaft 3 for dispensation of the composition can be applied by contacting a skin surface or other portion of a body of an individual to the distal portion of the head 2, such that with discharge of the defined dosage of the cosmetic composition from the aperture 9, the cosmetic composition contacts the skin surface or other portion of the body. As such, the head 2 is contactable to the surface (e.g., skin surface), such that the force applied to the shaft 3, in a direction of the surface, overcomes the bias member and slidably positions the head 2 toward the proximal position relative to the piston and concomitantly discharges the defined dosage of the cosmetic composition from the volume of the interior to the exterior of the head 2 through the aperture 9 by the piston. The distal portion of the head 2 can comprise the aperture 9 therethrough, such that as the distal portion of the head 2 contacts the portion of the body of the individual, the cosmetic composition can directly contact the skin surface after exiting the aperture 9. In this manner, the composition is more efficiently applied to the skin surface or other body portion, and there is reduced waste that is produced by the application process.

In embodiments, the distal portion of the head 2 is angled relative to an axis of the shaft 3 of the applicator 7. The distal portion of the head 2 can include a surface through which the aperture 9 passes, and the surface can be angled relative to the axis of the shaft 3 according to an angle that is not 90 degrees. The angle of the surface of the distal portion of the head 2 can facilitate ergonomic application of the composition during use, such that an individual grasping the applicator 7 does not necessarily need to position the shaft 3 about 90 degrees with respect to the portion of the body to which the composition is being applied. In this manner the applicator 7 is able to be more comfortably used for longer periods.

In embodiments, the bias member 10 is unitary with the head 2. As shown in the figures, including at least at FIGS. 2A-2R and optionally at FIGS. 3A-3L, the bias member 10 can be manufactured and utilized as a structural unit that includes other portions of the head 2 in a single piece of the overall assembly. While any materials can be used for the bias member 10, including metals, plastics, polymers, and the like, in various embodiments, the bias member 10 is generally flexible and able to store potential energy in a compressed configuration as the head 2 enters the proximal position (e.g., as shown at FIGS. 2B, 2D, 2F, 2H, 2J, 2L, 2N, 2P, 2R, 3B, 3D, 3F, 3H, 3J, and 3L). Upon release of a force from the head 2 of the applicator 7, the bias of the bias member 10 releases potential energy as it transitions to an expanded configuration, which returns the head 2 to the distal position (e.g., as shown at FIGS. 2A, 2C, 2E, 2G, 2I, 2K, 2M, 2O, 2Q, 3A, 3C, 3E, 3G, 3I, and 3K).

Figure 2A:
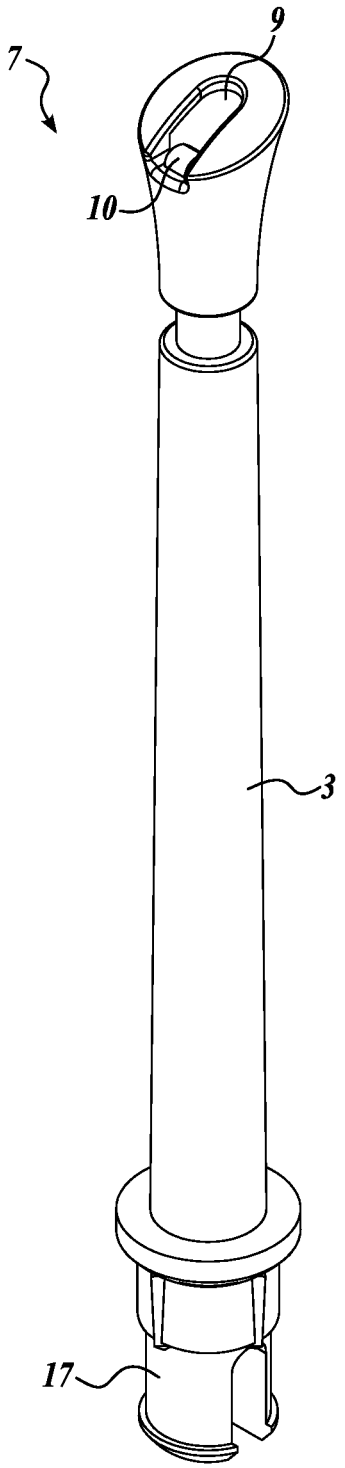
FIG. 2A shows a front perspective view of a first example applicator, with the head of the applicator in a distal position, according to aspects of the disclosure.
Figure 2B:
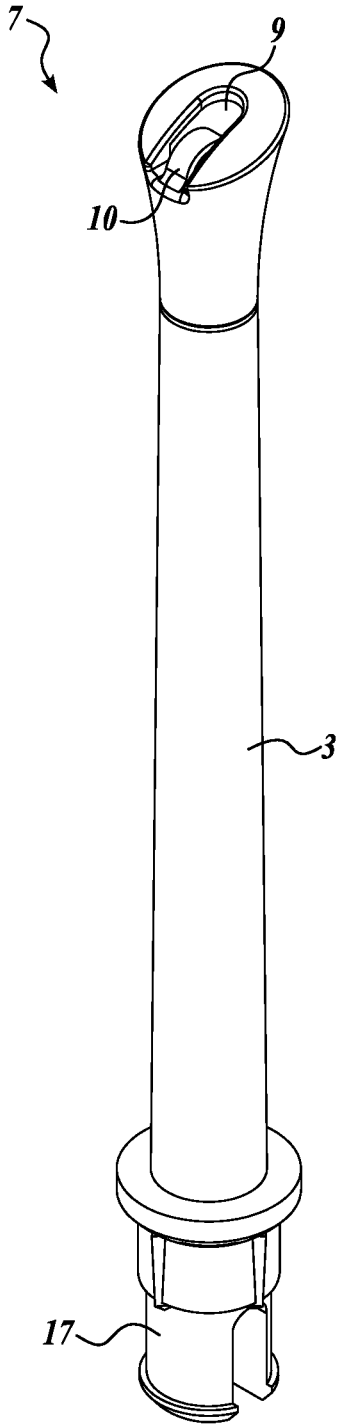
FIG. 2B shows a front perspective view of a first example applicator, with the head of the applicator in a proximal position, according to aspects of the disclosure.
Figure 2C:
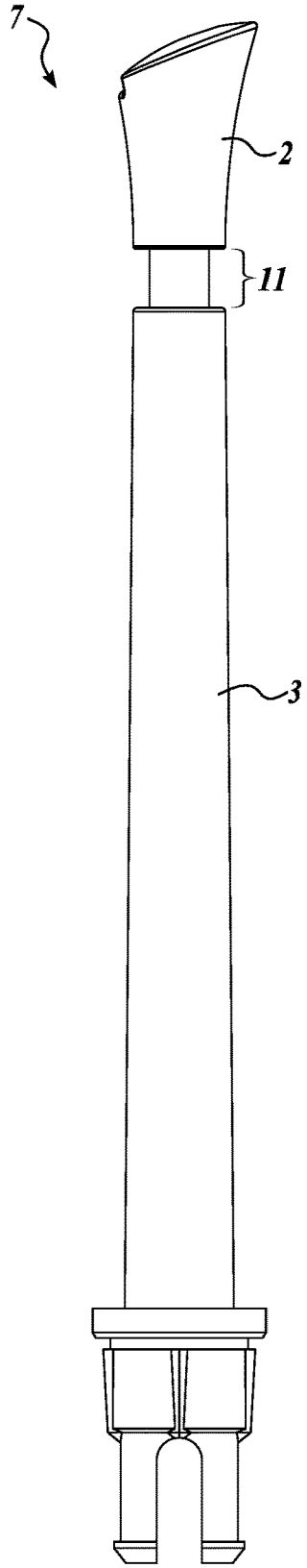
FIG. 2C shows a side view of a first example applicator, with the head of the applicator in a distal position.
Figure 2D:
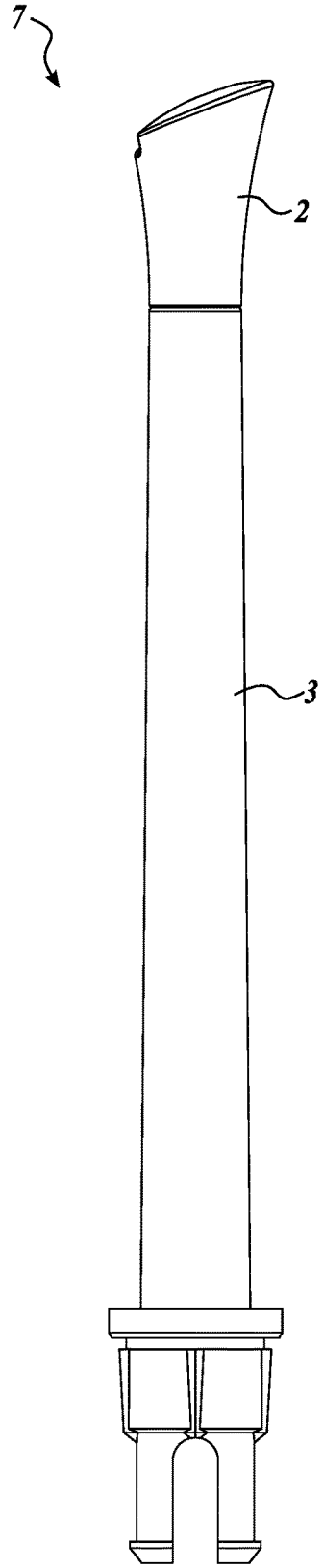
FIG. 2D shows a side view of a first example applicator, with the head of the applicator in a proximal position.
Figure 2E:
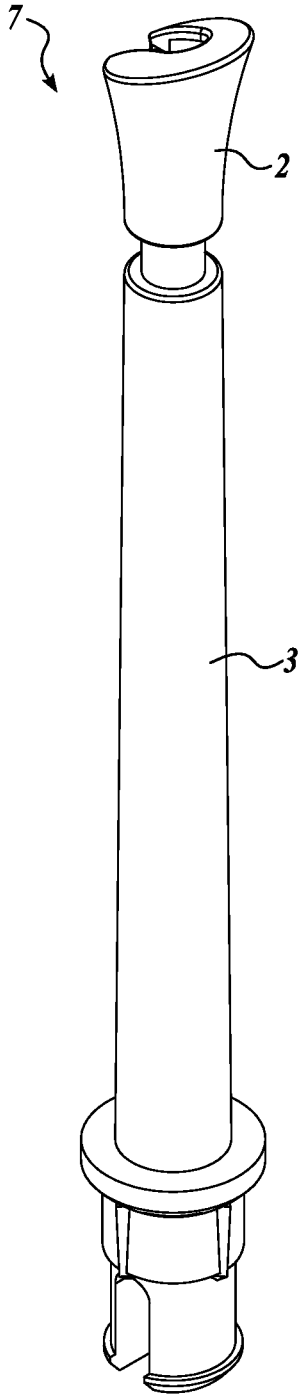
FIG. 2E shows a back perspective view of a first example applicator, with the head of the applicator in a distal position.
Figure 2F:
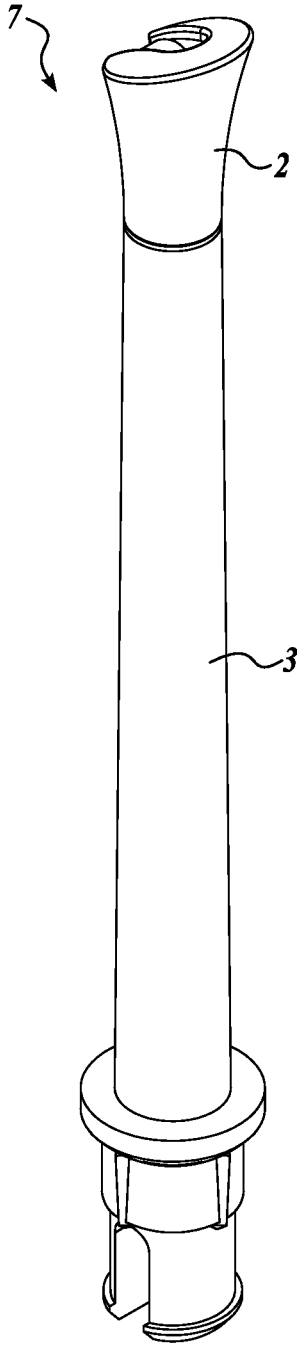
FIG. 2F shows a back perspective view of a first example applicator, with the head of the applicator in a proximal position.
Figure 2G:
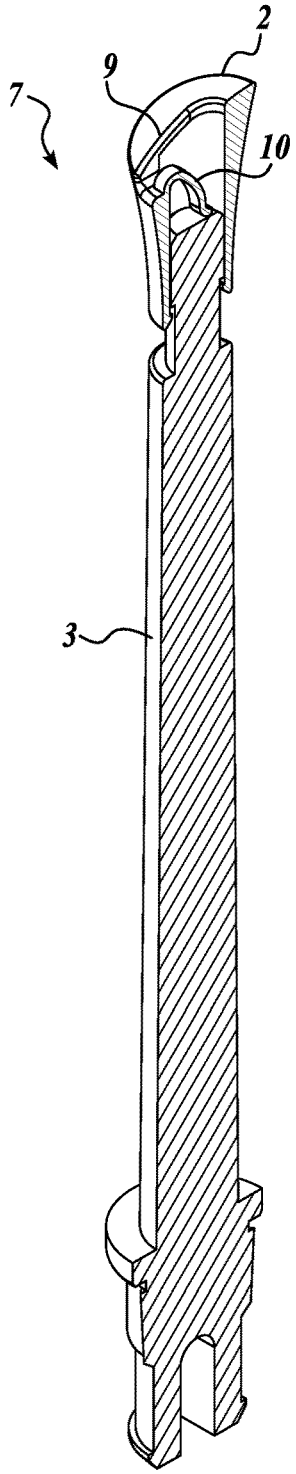
FIG. 2G shows a front perspective cross-sectional view of a first example applicator, with the head of the applicator in a distal position.
Figure 2H:
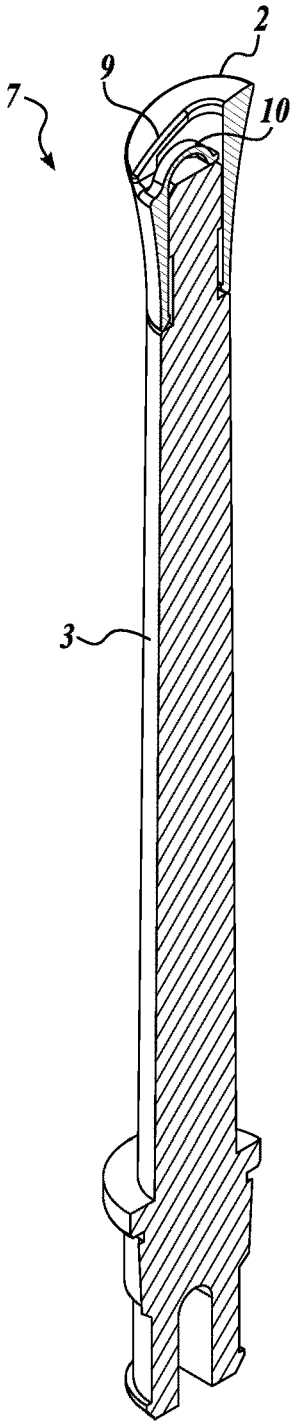
FIG. 2H shows a front perspective cross-sectional view of a first example applicator, with the head of the applicator in a proximal position.
Figure 2I:
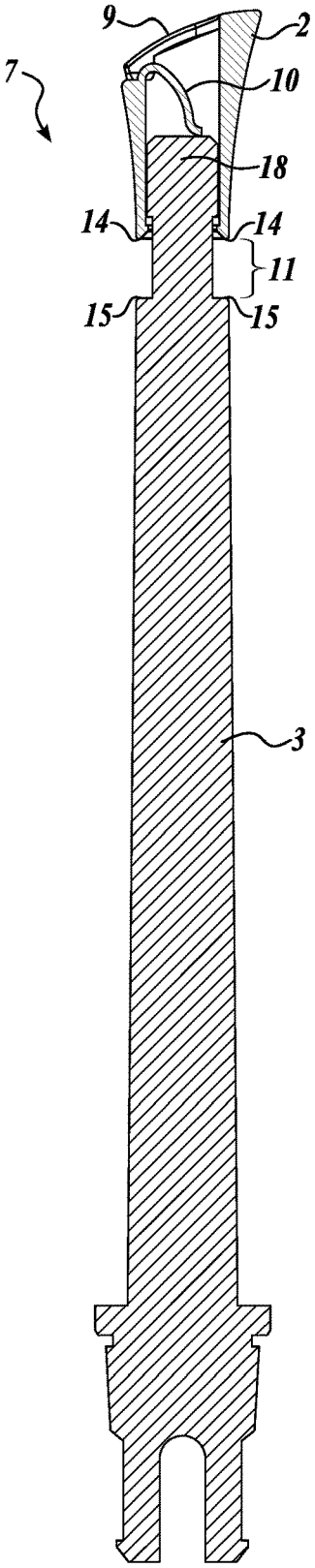
FIG. 2I shows a side cross-sectional view of a first example applicator, with the head of the applicator in a distal position.
Figure 2J:
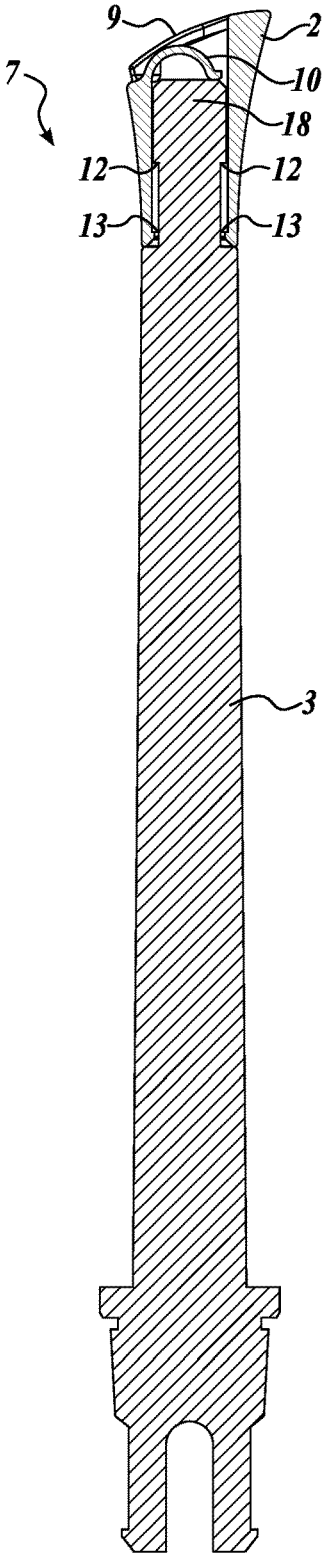
FIG. 2J shows a side cross-sectional view of a first example applicator, with the head of the applicator in a proximal position.
Figure 2K:
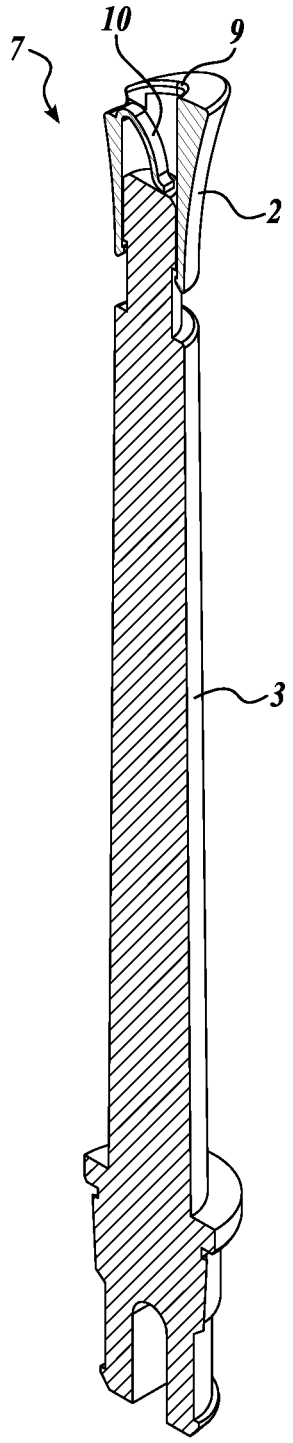
FIG. 2K shows a back perspective cross-sectional view of a first example applicator, with the head of the applicator in a distal position.
Figure 2L:
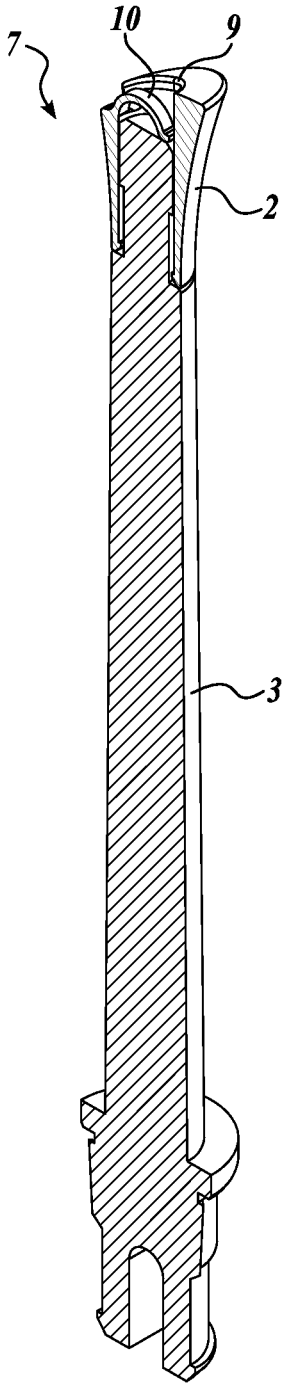
FIG. 2L shows a back perspective cross-sectional view of a first example applicator, with the head of the applicator in a proximal position.
Figure 2M:
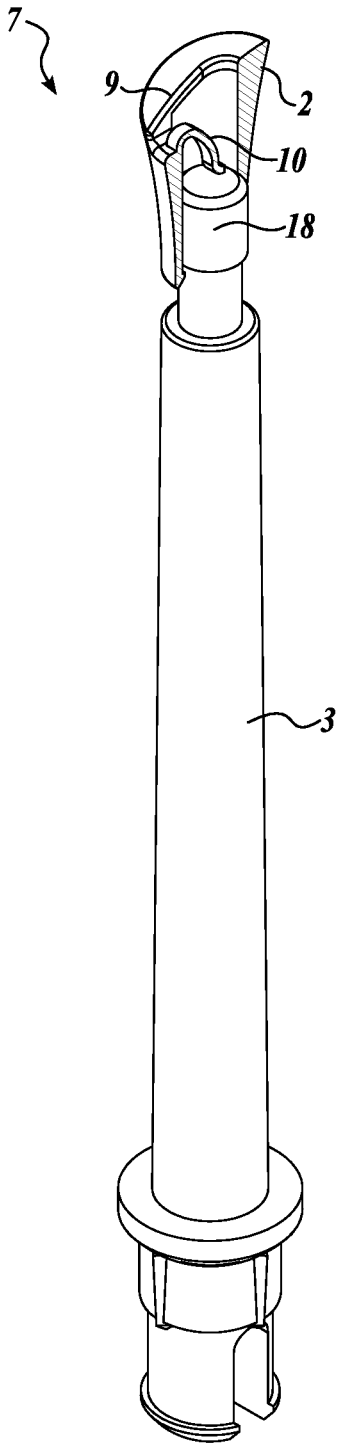
FIG. 2M shows a front perspective cutaway view of a first example applicator, with the head of the applicator in a distal position.
Figure 2N:
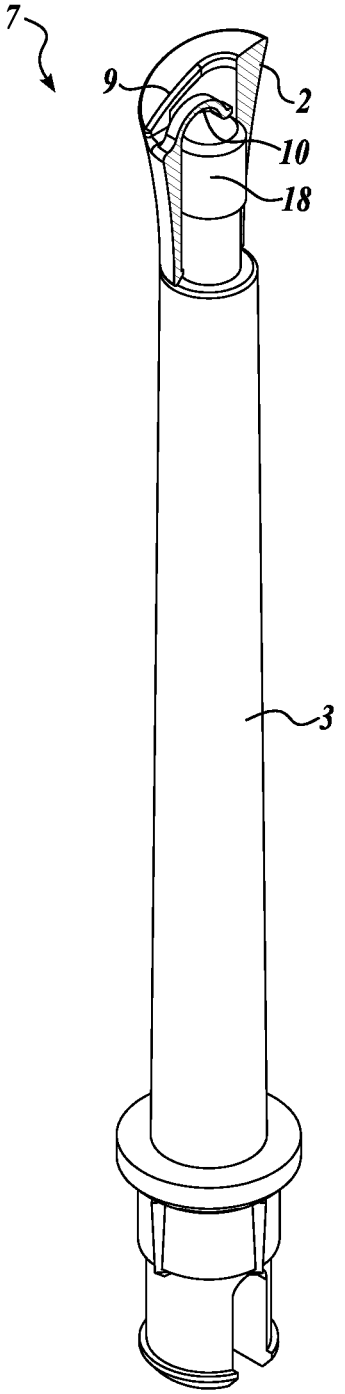
FIG. 2N shows a front perspective cutaway view of a first example applicator, with the head of the applicator in a proximal position.
Figure 2O:
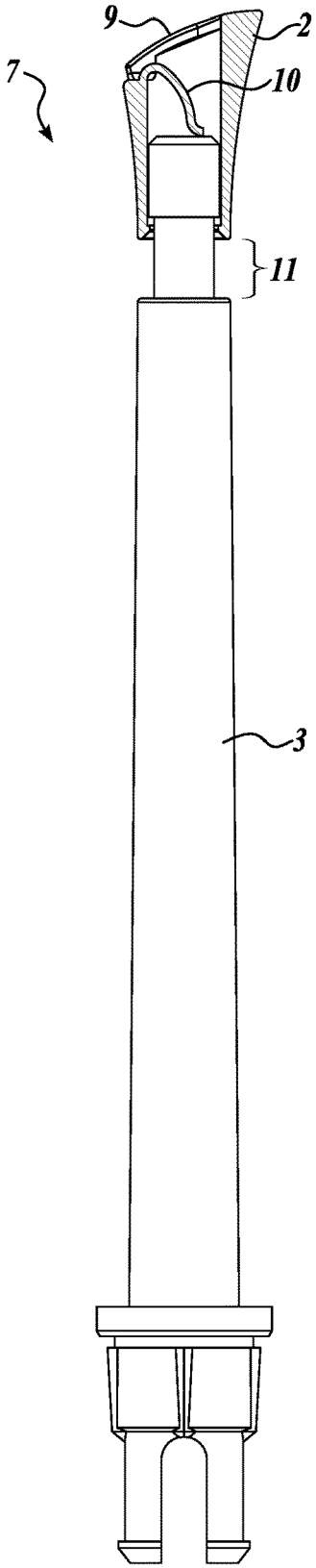
FIG. 2O shows a side cutaway view of a first example applicator, with the head of the applicator in a distal position.
Figure 2P:
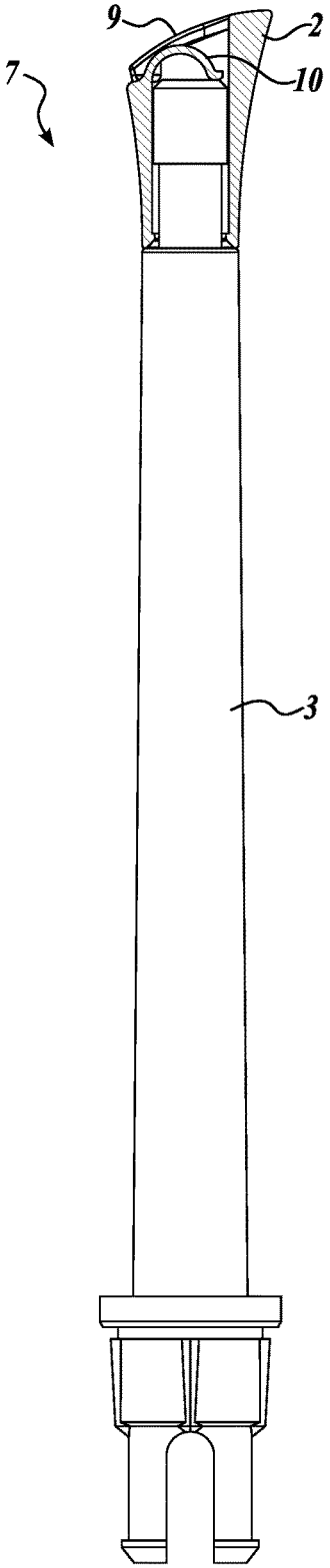
FIG. 2P shows a side cutaway view of a first example applicator, with the head of the applicator in a proximal position.
Figure 2Q:
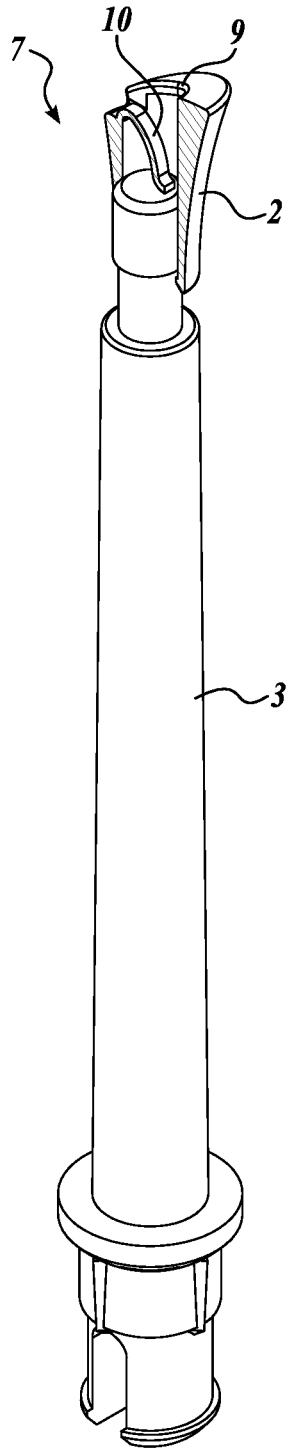
FIG. 2Q shows a back perspective cutaway view of a first example applicator, with the head of the applicator in a distal position.
Figure 2R:
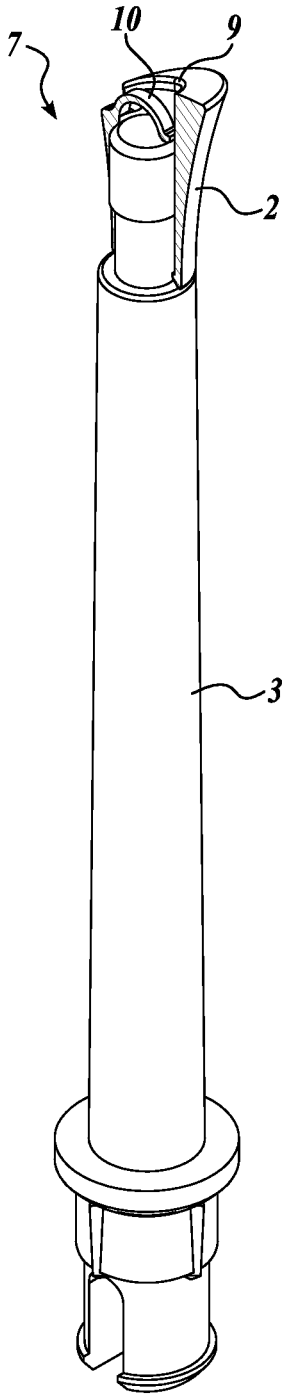
FIG. 2R shows a back perspective cutaway view of a first example applicator, with the head of the applicator in a proximal position.
Figure 3A:
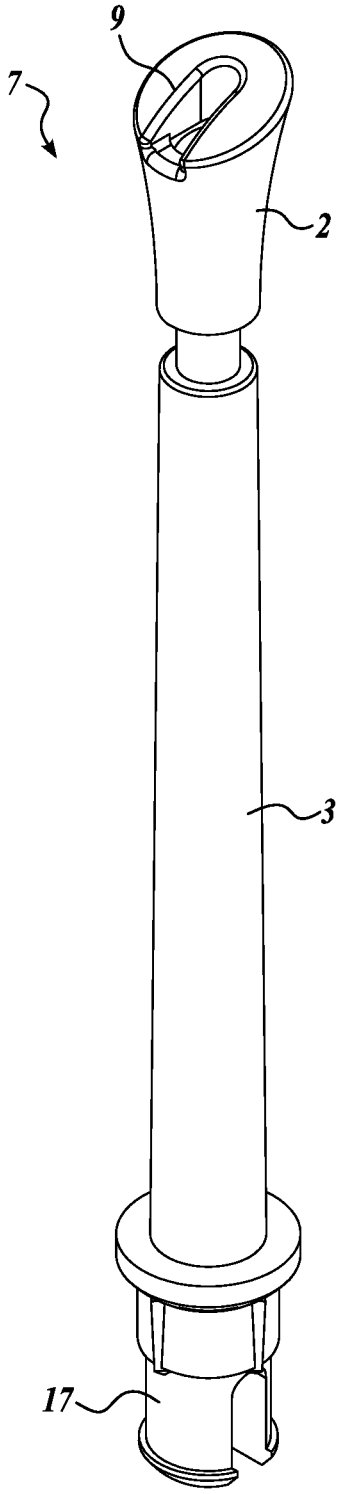
FIG. 3A shows a front perspective view of a second example applicator, with the head of the applicator in a distal position, according to aspects of the disclosure.
Figure 3B:
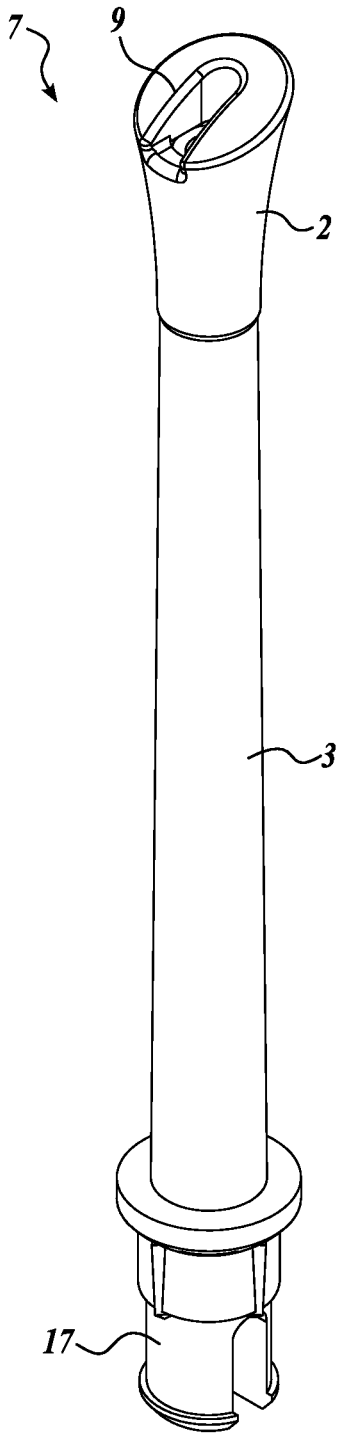
FIG. 3B shows a front perspective view of a second example applicator, with the head of the applicator in a proximal position, according to aspects of the disclosure.
Figure 3C:
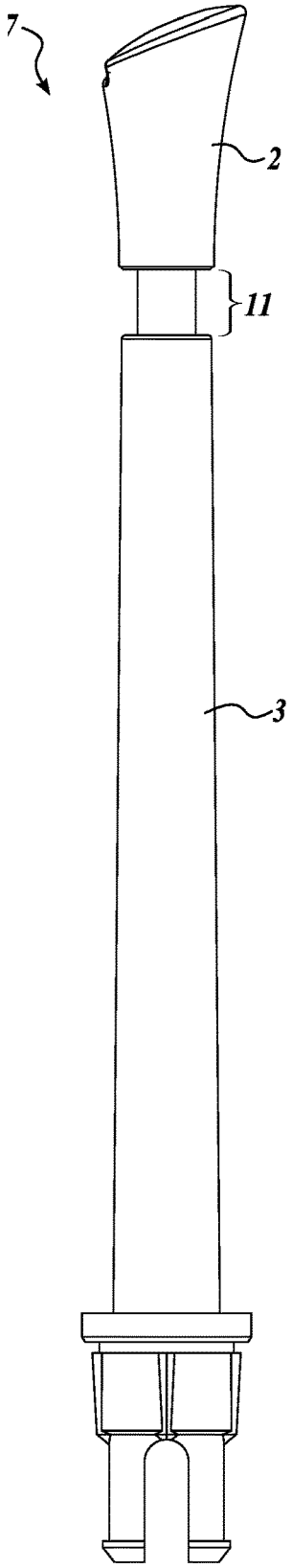
FIG. 3C shows a side view of a second example applicator, with the head of the applicator in a distal position.
Figure 3D:
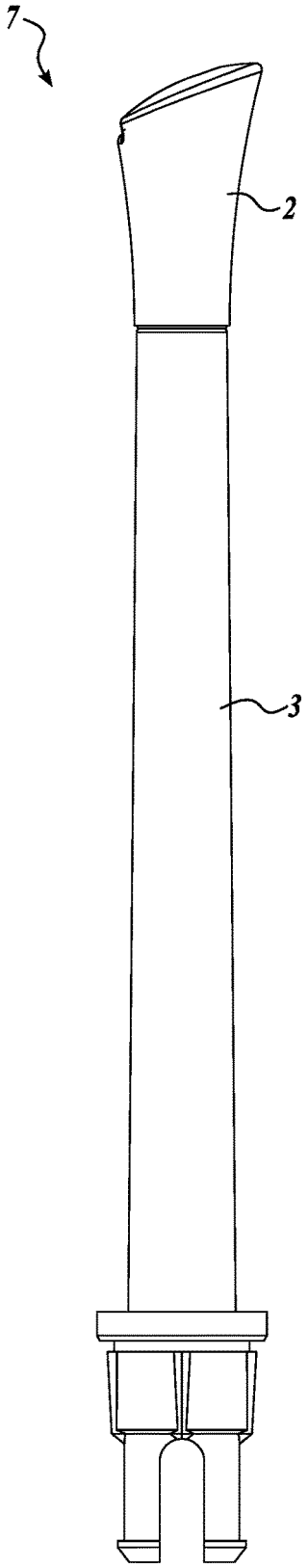
FIG. 3D shows a side view of a second example applicator, with the head of the applicator in a proximal position.
Figure 3E:
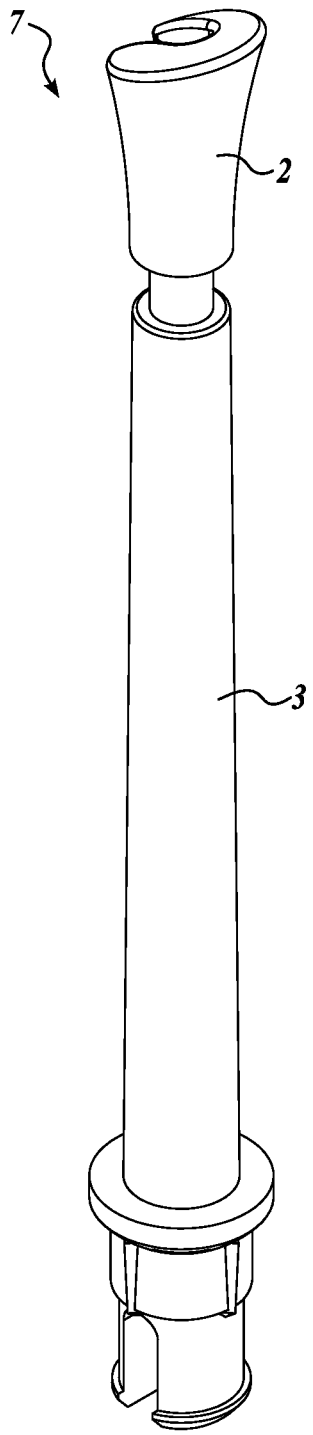
FIG. 3E shows a back perspective view of a second example applicator, with the head of the applicator in a distal position.
Figure 3F:
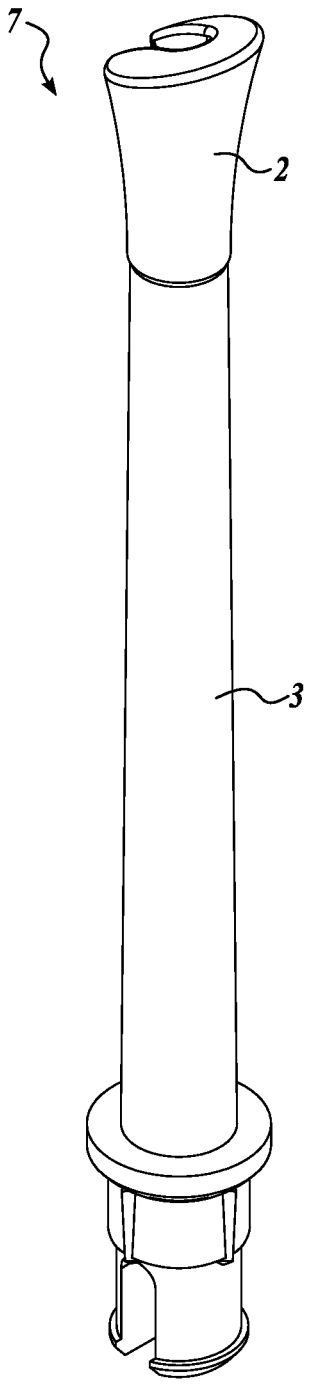
FIG. 3F shows a back perspective view of a second example applicator, with the head of the applicator in a proximal position.
Figure 3G:
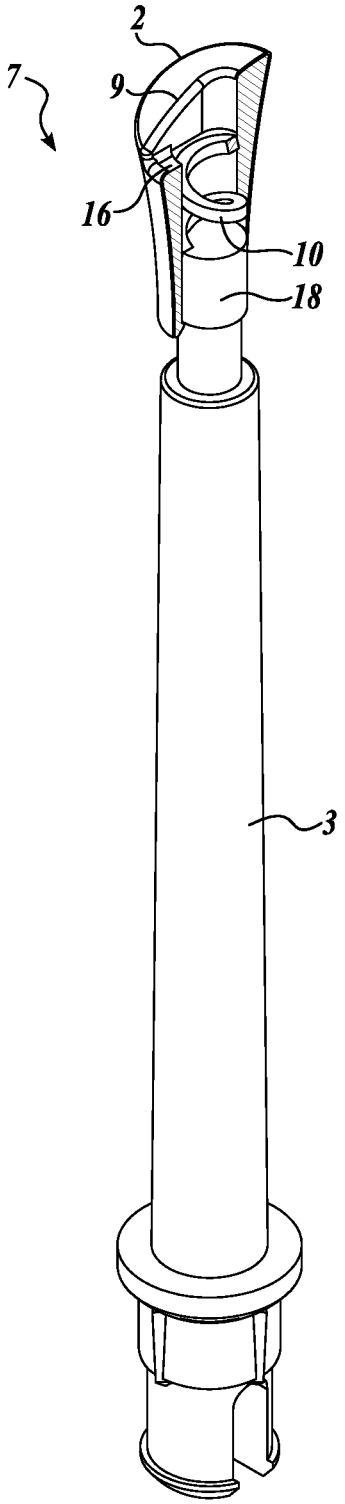
FIG. 3G shows a front perspective cutaway view of a second example applicator, with the head of the applicator in a distal position.
Figure 3H:
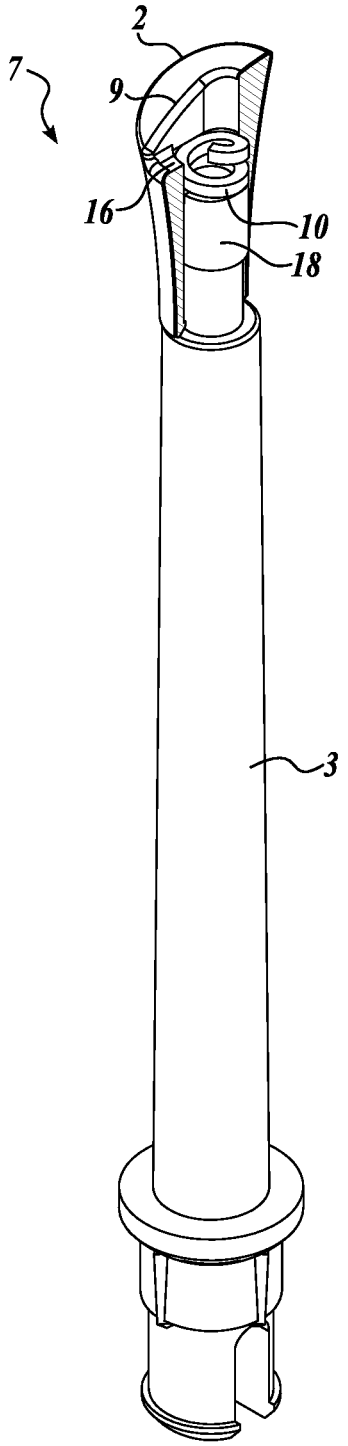
FIG. 3H shows a front perspective cutaway view of a second example applicator, with the head of the applicator in a proximal position.
Figure 3I:
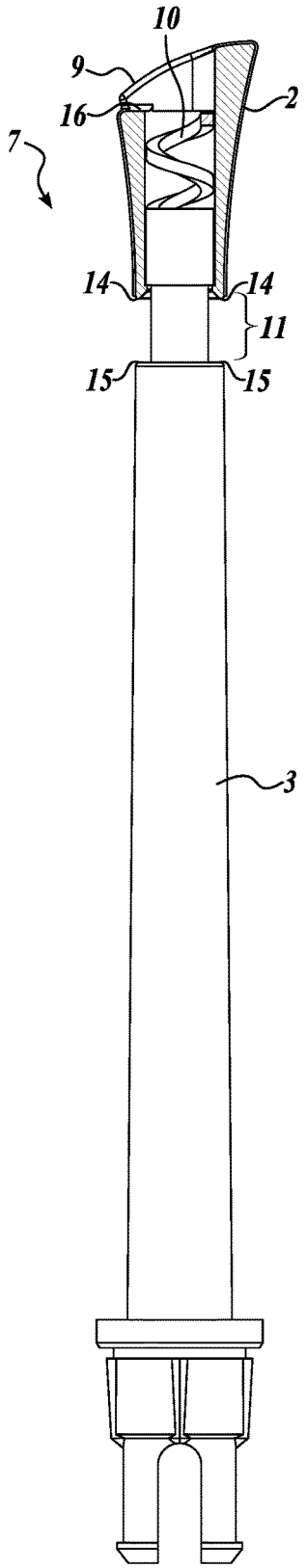
FIG. 3I shows a side cutaway view of a second example applicator, with the head of the applicator in a distal position.
Figure 3J:
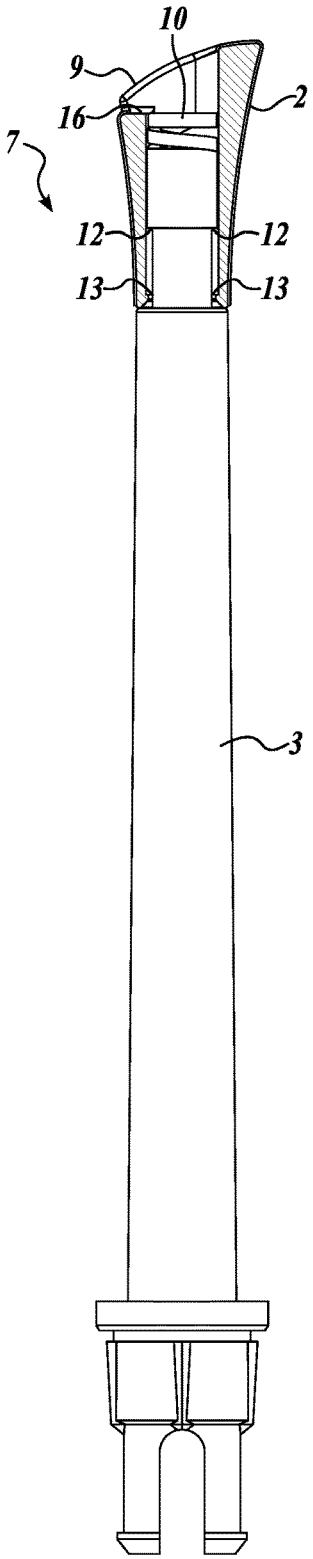
FIG. 3J shows a side cutaway view of a second example applicator, with the head of the applicator in a proximal position.
Figure 3K:
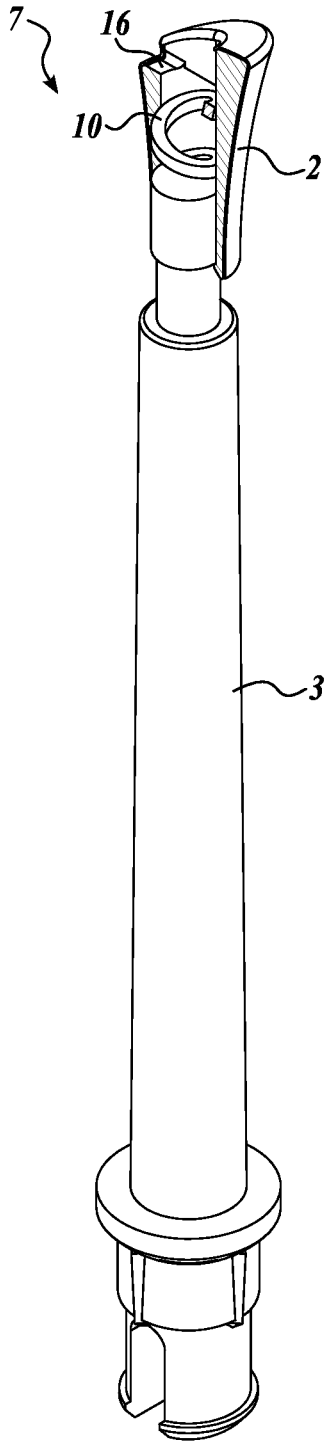
FIG. 3K shows a back perspective cutaway view of a second example applicator, with the head of the applicator in a distal position.
Figure 3L:
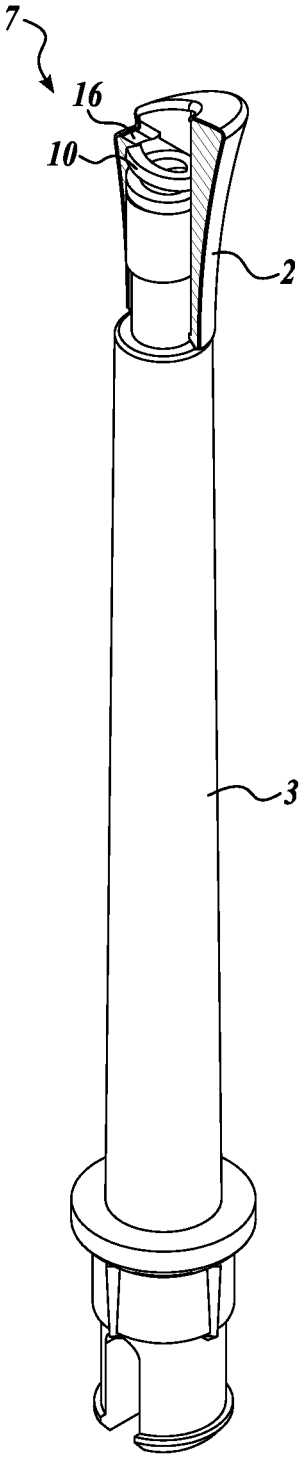
FIG. 3L shows a back perspective cutaway view of a second example applicator, with the head of the applicator in a proximal position.

In embodiments, the bias member 10 is a stem that extends from a rim of the aperture 9 into the volume of the interior of the head 2 and contacts the piston 18 of the shaft 3. As shown at FIGS. 2A-2R, an example stem form of the bias member 10 can include an arc to its shape, such that a base of the arc extends from the rim of the aperture 9 and a length and tip of the arc extend into the volume and contact the piston 18 of the shaft 3, respectively. The stem can be structurally narrow, such that the cosmetic composition passes around the stem as it exits the aperture 9 during use and is not inhibited by the stem. In this manner, the cosmetic composition is effectively applied during use.

In embodiments, the bias member 10 is a spring disposed between an interior ridge 16 of the head 2 and the piston 18 of the shaft 3. As shown at FIGS. 3A-3L, the spring can include a small deformable spring that is biased toward the expanded configuration and is compressed toward the compressed configuration. In embodiments, a size of the spring corresponds with the defined dosage of the cosmetic composition; for example, the spring can be longer to expand the piston 18 of the shaft 3 further to define a larger volume, or can be shorter to not expand the piston 18 of the shaft 3 as far, to define a smaller volume, according to need in a particular instance that can depend, for example, on the cosmetic composition to be used with the applicator 7. In embodiments, the interior ridge 16 of the head 2 is positioned adjacent to the aperture 9 of the head 2; in the shown embodiment, the interior ridge 16 of the head 2 can be contacted—directly or indirectly—by the spring of the bias member 10, such that the spring abuts against the interior ridge 16 of the head 2 to prevent the spring from entering upper volume of the head 2 immediately adjacent to the aperture 9, particularly when the spring is in the compressed configuration. In embodiments, the interior ridge 16 can comprise, for example, a small lip that extends radially inward from an interior wall of the head 2 of the applicator 7, and can be positioned below the aperture 9, for example. In embodiments, the interior ridge 16 can extend from all or part of a circumference of the interior wall of the head 2, and can form a circular aperture through which the composition passes, for example.

Figure 1B:
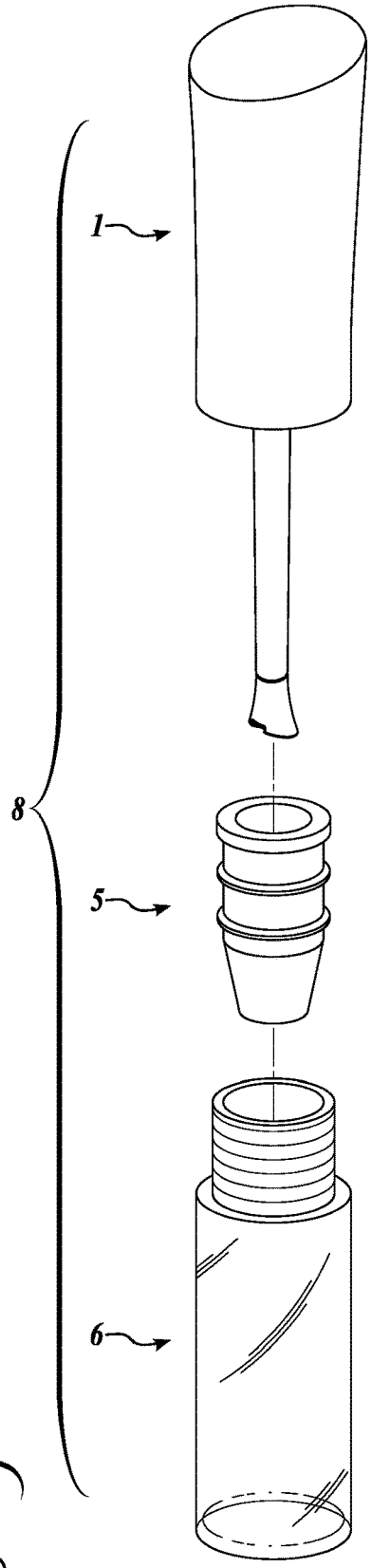
FIG. 1B shows a perspective exploded view of an example applicator, bottle, and wiper of a container assembly, according to aspects of the disclosure.

In embodiments, the shaft 3 comprises a handle attachment 17 at a distal portion thereof for attachment of the applicator 7 to a handle 4, as shown by way of example at FIGS. 1A-1B, 2A-2R, and 3A-3L. Handle attachment 17 can include any of various attachment structures for securement of the shaft 3 to the handle 4. In the shown examples, the handle attachment 17 includes a pair of flexible semi-circular flanges that can be depressed radially inward for insertion of the handle attachment 17 into handle 4, for example, as can occur during assembly of applicator 7 to form a handled applicator 1. As such, in embodiments, the applicator 7 further comprises the handle 4 attached to the handle attachment 17 of the shaft 3, forming the handled applicator 1 (e.g., as shown at FIGS. 1A and 1B).

In embodiments, the volume of the interior of the head 2 corresponds with, or defines, the defined dosage based on a size of the piston 18 of the shaft 3 and a distance traveled by the piston 18 as the head 2 transitions from the distal position to the proximal position relative to the piston 18, as shown by way of example at FIGS. 2A, 2C, 2E, 2G, 2I, 2K, 2M, 2O, 2Q, 3A, 3C, 3E, 3G, 3I, and 3K (distal position) and FIGS. 2B, 2D, 2F, 2H, 2J, 2L, 2N, 2P, 2R, 3B, 3D, 3F, 3H, 3J, and 3L (proximal position). In the shown embodiments, and as illustrated at FIGS. 2I and 2J, the piston 18 of the shaft 3 includes a size, e.g., a diameter, that is greater than a size, e.g., a diameter, of a portion 11 of the shaft 3 that enters the head 2 as the head 2 transitions from the distal position to the proximal position relative to the piston 18. This enables the portion 11 of the shaft 3 to slidably enter the head 2, and due to a hydraulic effect, results in a greater volume of composition displaced by the piston 18 due to its greater diameter. As would be understood by a person having ordinary skill in the art, the diameter of the piston 18 (and the interior diameter of the head 2) can be increased or decreased to adjust the volume of cosmetic composition displaced by movement of the piston 18, for example, as can be beneficial for particular cosmetic compositions or cosmetic compositions having particular characteristics (e.g., degree of viscosity).

In the shown embodiments, the piston 18 is separated from the rest of the shaft 3 by the portion 11 of the shaft 3, which includes a smaller diameter relative to the piston 18 and the rest of the shaft 3 and is defined by upper ridges 12 and lower ridges 15 on either side of the shaft 3 thereof. Upper ridges 12 of the shaft 3 abut against inner ridges 13 of the head 2 when the bias member 10 is in the expanded configuration (e.g., FIG. 2I), and lower ridges 15 of the shaft 3 abut against lower portions 14 of the head 2 when the bias member 10 is in the contracted configuration (e.g., FIG. 2J). In this manner, the piston 18 is secured within the head 2 and the inner ridges 13, which extend radially inward from the inner wall of the head, define a maximum distal position for the head 2 relative to the piston 18 and prevent complete removal of the shaft 3 from the head 2.

In an aspect, the disclosure provides a container assembly 8 for storing and delivering a defined dosage of a cosmetic composition (e.g., FIG. 1B), the container assembly 8 comprises an applicator (e.g., handled applicator 1) and a bottle 6, and optionally, a wiper 5 configured for attachment to an opening of the bottle and comprising an aperture for passage of the applicator therethrough for removal of excess cosmetic composition from the applicator during removal of the applicator from the bottle 6. In particular embodiments, a diameter of the applicator (e.g., a diameter of the shaft of the applicator) and a diameter of the wiper 5 (e.g., a diameter of the aperture of the wiper 5) are correlated or consistent with each other, for a snug fit of the wiper 5 to the applicator, during removal of the applicator from the bottle 6. In this manner, the wiper 5 removes excess cosmetic composition from the exterior of the applicator, such as the exterior of the shaft of the applicator, for reduced waste and more accurate application of the cosmetic composition.

In an aspect, the disclosure provides a kit comprising a container assembly (e.g., container assembly 8 of FIG. 1B) and further comprising an instructional material, a product material, or an accessory. The instructional material can include instructions for storage, use, or maintenance of the applicator or the container assembly or a component thereof, or the cosmetic composition, for example, and the product material can include information about the cosmetic composition, such as ingredients and other information. The accessory can include alternate or replacement applicators for use with the container assembly, for example.

NON-LIMITING EMBODIMENTS

While general features of the disclosure are described and shown and particular features of the disclosure are set forth in the claims, the following non-limiting embodiments relate to features, and combinations of features, that are explicitly envisioned as being part of the disclosure. The following non-limiting Embodiments contain elements that are modular and can be combined with each other in any number, order, or combination to form a new non-limiting Embodiment, which can itself be further combined with other non-limiting Embodiments.

Embodiment 1. An applicator for application of a defined dosage of a cosmetic composition, the applicator comprising: a head comprising an aperture that fluidly connects an exterior of the head to an interior of the head, wherein the head is slidably affixed to a shaft comprising a piston that is slidably positioned within the head; and a bias member that biases the head toward a distal position relative to the piston, wherein the distal position corresponds to a volume of the interior of the head for storage of the defined dosage of the cosmetic composition, wherein a force applied to the head toward the piston overcomes the bias member and slides the head along a length of the shaft and toward a proximal position relative to the piston for discharge of the defined dosage of the cosmetic composition from the volume of the interior through the aperture by the piston.

Embodiment 2. The applicator of any other Embodiment, wherein the aperture is disposed through a distal portion of the head and wherein the force is applied with contact of a skin surface to the distal portion of the head, such that with discharge of the defined dosage of the cosmetic composition from the aperture, the cosmetic composition contacts the skin surface.

Embodiment 3. The applicator of any other Embodiment, wherein the distal portion of the head is angled relative to an axis of the shaft of the applicator.

Embodiment 4. The applicator of any other Embodiment, wherein the bias member is unitary with the head.

Embodiment 5. The applicator of any other Embodiment, wherein the bias member is a stem that extends from a rim of the aperture into the volume of the interior of the head and contacts the piston of the shaft.

Embodiment 6. The applicator of any other Embodiment, wherein the bias member is a spring disposed between an interior ridge of the head and the piston.

Embodiment 7. The applicator of any other Embodiment, wherein a size of the spring corresponds with the defined dosage of the cosmetic composition.

Embodiment 8. The applicator of any other Embodiment, wherein the interior ridge of the head is positioned adjacent to the aperture of the head.

Embodiment 9. The applicator of any other Embodiment, wherein the shaft comprises a handle attachment at a distal portion thereof for attachment of the applicator to a handle.

Embodiment 10. The applicator of any other Embodiment, further comprising the handle attached to the handle attachment of the shaft.

Embodiment 11. The applicator of any other Embodiment, wherein the volume of the interior of the head corresponds with the defined dosage based on a size of the piston and a distance traveled by the piston as the head transitions from the distal position to the proximal position relative to the piston.

Embodiment 12. The applicator of any other Embodiment, wherein the size of the piston is greater than a size of a portion of the shaft that enters the head as the head transitions from the distal position to the proximal position relative to the piston.

Embodiment 13. A container assembly for storing and delivering a defined dosage of a cosmetic composition, the container assembly comprising the applicator of any other Embodiment and a bottle, and optionally, a wiper configured for attachment to an opening of the bottle and comprising an aperture for passage of the applicator therethrough for removal of excess cosmetic composition from the applicator during removal of the applicator from the bottle.

Embodiment 14. The container assembly of any other Embodiment, wherein a diameter of the applicator and a diameter of the wiper are consistent with each other for a snug fit of the wiper to the applicator during removal of the applicator from the bottle.

Embodiment 15. A kit comprising the container assembly of any other Embodiment and further comprising an instructional material, a product material, or an accessory.

While illustrative embodiments have been illustrated and described, it will be appreciated that various changes can be made therein without departing from the spirit and scope of the invention.

The embodiments of the invention in which an exclusive property or privilege is claimed are defined as follows:

1. An applicator for application of a defined dosage of a cosmetic composition to a surface, the applicator comprising:

a head comprising an aperture that fluidly connects an exterior of the head to an interior of the head, wherein the head is slidably affixed to a shaft comprising a piston that is slidably positioned within the head; and a bias member that biases the head toward a distal position relative to the piston, wherein the distal position corresponds to a volume of the interior of the head for storage of the defined dosage of the cosmetic composition;

wherein the head is positionable within a bottle that comprises the cosmetic composition therein, such that a force applied to the shaft in a direction of a lower portion of the bottle contacts the head to the lower portion of the bottle, overcomes the bias member, and slidably positions the head toward a proximal position relative to the piston, and such that removal of the force from the shaft removes the head from contact with the lower portion of the bottle, releases the bias member, and slidably positions the head toward the distal position relative to the piston and concomitantly draws the defined dosage of the cosmetic composition from the exterior of the head into the volume of the interior through the aperture by the piston; and wherein the head is contactable to the surface, such that the force applied to the shaft in a direction of the surface overcomes the bias member and slidably positions the head toward the proximal position relative to the piston and concomitantly discharges the defined dosage of the cosmetic composition from the volume of the interior to the exterior of the head through the aperture by the piston.

2. The applicator of claim 1, wherein the aperture is disposed through a distal portion of the head and wherein the force is applied with contact of a skin surface to the distal portion of the head, such that with discharge of the defined dosage of the cosmetic composition from the aperture, the cosmetic composition contacts the skin surface.

3. The applicator of claim 2, wherein the distal portion of the head is angled relative to an axis of the shaft of the applicator.

4. The applicator of claim 1, wherein the bias member is unitary with the head.

5. The applicator of claim 4, wherein the bias member is a stem that extends from a rim of the aperture into the volume of the interior of the head and contacts the piston of the shaft.

6. The applicator of claim 1, wherein the bias member is a spring disposed between an interior ridge of the head and the piston.

7. The applicator of claim 6, wherein a size of the spring corresponds with the defined dosage of the cosmetic composition.

8. The applicator of claim 6, wherein the interior ridge of the head is positioned adjacent to the aperture of the head.

9. The applicator of claim 1, wherein the shaft comprises a handle attachment at a distal portion thereof for attachment of the applicator to a handle.

10. The applicator of claim 9, further comprising the handle attached to the handle attachment of the shaft.

11. The applicator of claim 1, wherein the volume of the interior of the head corresponds with the defined dosage based on a size of the piston and a distance traveled by the piston as the head transitions from the distal position to the proximal position relative to the piston.

12. The applicator of claim 11, wherein the size of the piston is greater than a size of a portion of the shaft that enters the head as the head transitions from the distal position to the proximal position relative to the piston.

13. A container assembly for storing and delivering a defined dosage of a cosmetic composition, the container assembly comprising the applicator of claim 1, the bottle, and a wiper configured for attachment to an opening of the bottle and comprising an aperture for passage of the applicator therethrough for removal of excess cosmetic composition from the applicator during removal of the applicator from the bottle.

14. The container assembly of claim 13, wherein a diameter of the applicator and a diameter of the wiper are consistent with each other for a snug fit of the wiper to the applicator during removal of the applicator from the bottle.

15. A kit comprising the container assembly of claim 13 and further comprising an instructional material, a product material, or an accessory.

* * * * *